US010894220B2

(12) United States Patent
Pruzansky et al.

(10) Patent No.: US 10,894,220 B2
(45) Date of Patent: Jan. 19, 2021

(54) DRAWING DEVICE

(71) Applicant: SPIN MASTER LTD., Toronto (CA)

(72) Inventors: Amy A. Pruzansky, Toronto (CA); Benjamin E. Dermer, Toronto (CA); Emma J. E. Peat, Toronto (CA)

(73) Assignee: SPIN MASTER LTD., Toronto (CA)

( * ) Notice: Subject to any disclaimer, the term of this patent is extended or adjusted under 35 U.S.C. 154(b) by 220 days.

(21) Appl. No.: 15/959,736

(22) Filed: Apr. 23, 2018

(65) Prior Publication Data

US 2019/0321742 A1 Oct. 24, 2019

(51) Int. Cl.
*B43L 1/00* (2006.01)
*A63H 33/26* (2006.01)

(52) U.S. Cl.
CPC ..... *A63H 33/26* (2013.01); *B43L 1/008* (2013.01)

(58) Field of Classification Search
CPC ..... A63H 13/02; A63H 13/03; A63H 29/22; A63H 3/50; A63H 3/52; A63H 11/00; A63H 13/16; A63H 2200/00; A63H 33/26; A63H 3/006; A63H 3/08; A63H 3/18; A63H 3/36; B43L 1/00; B43L 1/008; B43L 1/12
USPC ..... 33/18.1
See application file for complete search history.

(56) References Cited

U.S. PATENT DOCUMENTS 3,055,113 A * 9/1962 Grandjean ..... G09B 11/00 33/18.1
3,416,231 A 12/1968 Mercorelli
3,760,505 A * 9/1973 Clark ..... B43L 1/126 33/18.1
3,878,616 A 4/1975 Arrieta
4,251,920 A 2/1981 Cassagnes
4,364,176 A 12/1982 Cassagnes et al.
4,717,109 A 1/1988 Johnston
4,764,763 A 8/1988 Wickstead et al.
4,887,968 A 12/1989 Wickstead et al.
(Continued)

FOREIGN PATENT DOCUMENTS

CN 201195447 Y 2/2009
CN 103424922 A 12/2013
(Continued)

OTHER PUBLICATIONS

EP 19168730, European Search Report, dated Sep. 11, 2019, European Patent Office.
(Continued)

*Primary Examiner* — Yaritza Guadalupe-McCall
(74) *Attorney, Agent, or Firm* — Millman IP Inc.

(57) ABSTRACT

A drawing device with a rotatable display screen is provided, having a housing having a cavity therein and a display screen sealingly rotatably coupled to the housing. An inner surface of the display screen forms an enclosure with the cavity. A powder is contained within the enclosure, the powder being removably adherent to the inner surface of the display screen. A first stylus controller is supported on an exterior of the housing. At least one positioning structure is supported in the enclosure and coupled to the first stylus controller to move a first stylus in a first set of directions that are parallel to a first axis. The first stylus removes the powder from the inner surface of the display screen through contact with the inner surface of the display screen.

19 Claims, 10 Drawing Sheets

(56) References Cited

U.S. PATENT DOCUMENTS

| | | | | |
|---|---|---|---|---|
| 4,888,874 | A | 12/1989 | Oster | |
| 4,949,466 | A | 8/1990 | Auer et al. | |
| 5,038,482 | A | 8/1991 | Anderson et al. | |
| 5,148,601 | A | 9/1992 | Anderson et al. | |
| 5,156,684 | A | 10/1992 | Mayer et al. | |
| 5,212,874 | A | 5/1993 | Anderson et al. | |
| 5,279,039 | A | 1/1994 | Anderson et al. | |
| 5,321,891 | A * | 6/1994 | Arad | B43L 13/046 33/18.1 |
| 5,562,452 | A | 10/1996 | Atugi et al. | |
| 5,752,870 | A | 5/1998 | Karasawa et al. | |
| 5,867,914 | A * | 2/1999 | Watson | B43L 1/00 33/18.1 |
| 8,075,982 | B2 | 12/2011 | Donahue | |
| 2014/0170603 | A1* | 6/2014 | Ranftl | B43L 1/004 434/81 |

FOREIGN PATENT DOCUMENTS

| | | | |
|---|---|---|---|
| CN | 210760024 | U | 6/2020 |
| GB | 745264 | A | 2/1956 |
| GB | 2239218 | B | 1/1993 |
| WO | 2012/090192 | A1 | 7/2012 |

OTHER PUBLICATIONS

Examination Report dated Aug. 28, 2020 for corresponding European Application No. 19168730.0.
Office Action and Search Report dated Oct. 28, for corresponding Chinese Application No. 201910317878.0.

* cited by examiner

DRAWING DEVICE

FIELD

The specification relates generally to drawing systems. In particular, the following relates to a drawing device.

BACKGROUND OF THE DISCLOSURE

A variety of recreational drawing devices for creating drawings on an erasable drawing surface exist. One such popular device marketed under the trade name "Etch A Sketch" was manufactured and sold by the Ohio Art Company. This drawing device has a generally rectangular housing that has a glass screen on its front surface. Drawing can be performed using a pair of control knobs that enable linear movement of a stylus impinging upon an inner surface of the glass screen inside of the housing along two orthogonal axes. As the stylus is moved, it removes a metallic powder present in the housing that adheres to surfaces from an inner surface of the glass screen. Using this device, however, drawing is limited to lines along the two orthogonal axes. Although the two control knobs can be simultaneously controlled to generate other lines, such as lines that are oblique to the two orthogonal axes, these lines are formed as compilations of line segments along the two orthogonal axes.

Another set of devices for drawing include a stylus that is pivotally mounted and controlled to draw on a curved inner surface of a screen of the devices. These devices, however, suffer from a number of issues. The structures to pivot the styli are particularly subject to failure. Further, one of these devices employs a bellowed membrane to seal the metallic powder. These bellowed membranes were also subject to failure, enabling the metallic powder to escape and reducing the effectiveness of the device.

SUMMARY OF THE DISCLOSURE

In one aspect, there is provided a drawing device, comprising: a housing having a cavity therein; a display screen sealingly rotatably coupled to the housing, an inner surface of which forms an enclosure with the cavity; a powder contained within the enclosure, the powder being removably adherent to the inner surface of the display screen; a first stylus controller supported on an exterior of the housing; and at least one positioning structure supported in the enclosure coupled to the first stylus controller to move a first stylus in a first set of directions that are parallel to a first axis, the first stylus removing the powder from the inner surface of the display screen through contact with the inner surface of the display screen.

The drawing device can further include a second stylus controller supported on the exterior of the housing, wherein the at least one positioning structure is coupled to the second stylus controller to move the first stylus in a second set of directions that are parallel to a second axis.

The second axis can be orthogonal to the first axis.

The at least one positioning structure can additionally move a second stylus in the first set of directions via the first stylus controller and in the second set of directions via the second stylus controller, the second stylus removing the powder from the inner surface of the display screen through contact with the inner surface of the display screen.

The drawing device can further include a display screen rotation controller supported on the exterior of the housing and controlling rotation of the display screen relative to the housing. The drawing device can further include a rotation structure coupled to the display screen rotation controller and positioned within the cavity of the housing to reorient the display screen.

The display screen can form part of a display screen assembly having a feature permitting manual rotation thereof.

The inner surface of the display screen can be planar. The first axis can be parallel to the inner surface of the display screen.

The inner surface of the display screen can be planar, and the first and second axes can be parallel to the inner surface of the display screen.

One of an assembly of the display screen and the housing can have a set of detents that are regularly angularly displaced and engaged by a biasable feature on another of the assembly of the display screen and the housing, the display screen being rotatable upon application of a threshold torque force thereon.

The housing can have a pan to which loose powder can fall that is positioned below a seal between the housing and the display screen.

In another aspect, there is provided a drawing device, comprising: a housing having a cavity therein; a display screen sealingly coupled to the housing, an inner surface of which forms an enclosure with the cavity; a powder contained within the enclosure, the powder being removably adherent to the inner surface of the display screen; a first stylus controller supported on an exterior of the housing; and at least one positioning structure supported in the enclosure coupled to the first stylus controller to simultaneously move a first stylus and a second stylus in a first set of directions that are parallel to a first axis, the first stylus and the second stylus removing the powder from the inner surface of the display screen through contact with the inner surface of the display screen.

The drawing device can further include a second stylus controller supported on the exterior of the housing, wherein the at least one positioning structure is coupled to the second stylus controller to simultaneously move the first stylus and the second stylus in a second set of directions that are parallel to a second axis. The second axis can be orthogonal to the first axis.

The at least one positioning structure simultaneously can move the first stylus in a first of the first set of directions and the second stylus in a second stylus in a second of the first set of directions that is opposite the first of the first set of directions. The at least one positioning structure can simultaneously move the first stylus and the second stylus in a first of the second set of directions.

The at least one positioning structure can comprise: a first set of pulleys; a first endless cable routed around the first set of pulleys and having a delivery portion and a return portion; wherein the first stylus is coupled to the delivery portion of the first endless cable; and wherein the second stylus is coupled to the return portion of the first endless cable.

The at least one positioning structure can comprise: a second set of pulleys; and a second endless cable routed around the second set of pulleys and having a delivery portion and a return portion, wherein the first stylus is coupled to the delivery portion of the second endless cable that is simultaneously moved with the delivery portion of the first endless cable in a first direction, and wherein the second stylus is coupled to the return portion of the second endless cable that is simultaneously moved with the return portion of the first endless cable in a second direction opposite the first direction.

The at least one positioning structure can comprise: a third set of pulleys; a third endless cable routed around the third set of pulleys and having a delivery portion and a return portion; a fourth set of pulleys; and a fourth endless cable routed around the fourth set of pulleys and having a delivery portion and a return portion, wherein the first stylus and the second stylus are coupled to the delivery portion of the third endless cable and the fourth endless cable that simultaneously move in a third direction.

BRIEF DESCRIPTIONS OF THE DRAWINGS

For a better understanding of the various embodiments described herein and to show more clearly how they may be carried into effect, reference will now be made, by way of example only, to the accompanying drawings in which.

DETAILED DESCRIPTION

Figure 1A:
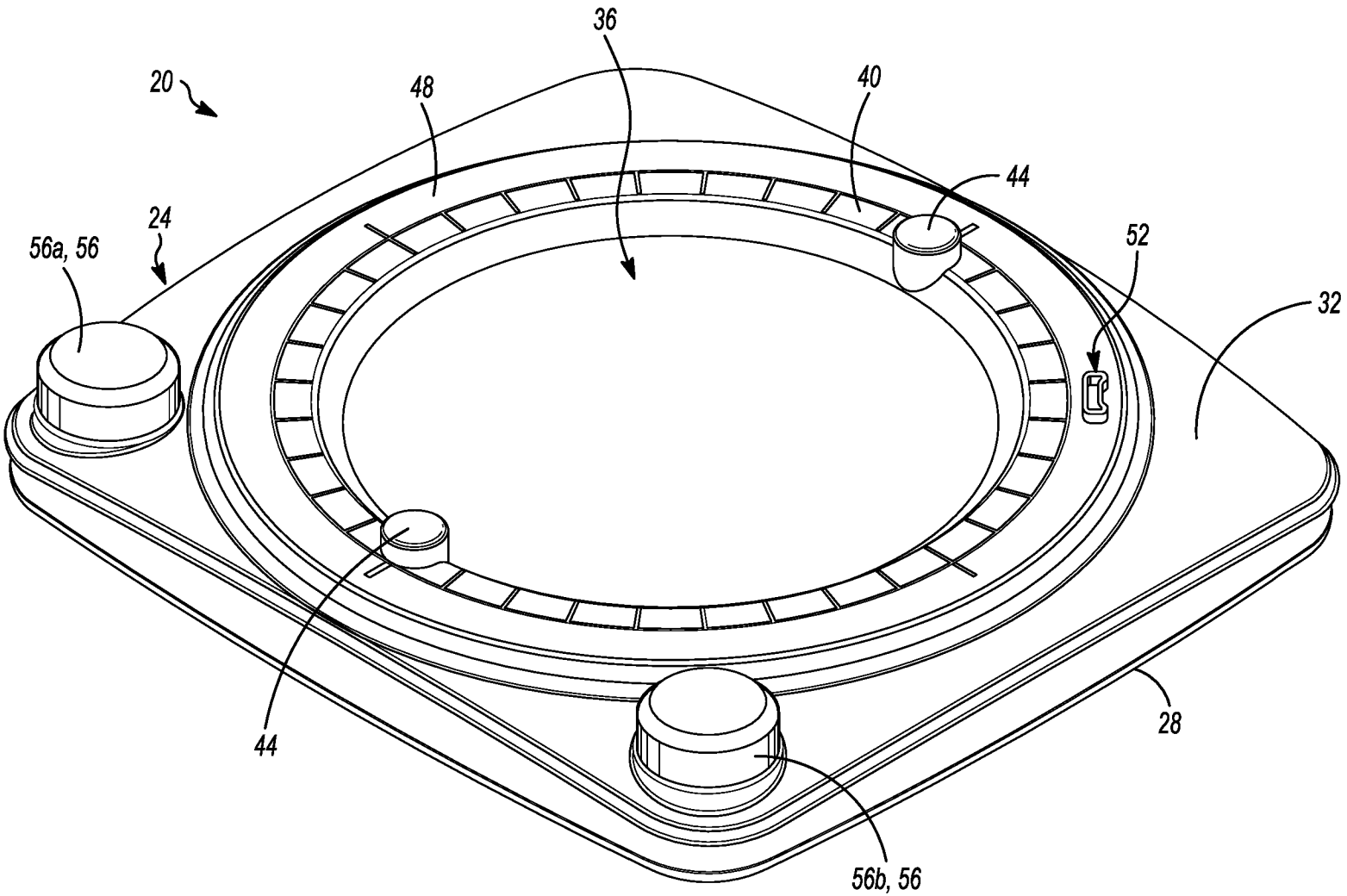
FIG. 1A is a top left front isometric view of a drawing device with a rotatable display screen in accordance with an embodiment thereof.

For simplicity and clarity of illustration, where considered appropriate, reference numerals may be repeated among the Figures to indicate corresponding or analogous elements. In addition, numerous specific details are set forth in order to provide a thorough understanding of the embodiments described herein. However, it will be understood by those of ordinary skill in the art that the embodiments described herein may be practiced without these specific details. In other instances, well-known methods, procedures and components have not been described in detail so as not to obscure the embodiments described herein. Also, the description is not to be considered as limiting the scope of the embodiments described herein.

Various terms used throughout the present description may be read and understood as follows, unless the context indicates otherwise: "or" as used throughout is inclusive, as though written "and/or"; singular articles and pronouns as used throughout include their plural forms, and vice versa; similarly, gendered pronouns include their counterpart pronouns so that pronouns should not be understood as limiting anything described herein to use, implementation, performance, etc. by a single gender; "exemplary" should be understood as "illustrative" or "exemplifying" and not necessarily as "preferred" over other embodiments. Further definitions for terms may be set out herein; these may apply to prior and subsequent instances of those terms, as will be understood from a reading of the present description.

Figure 1B:
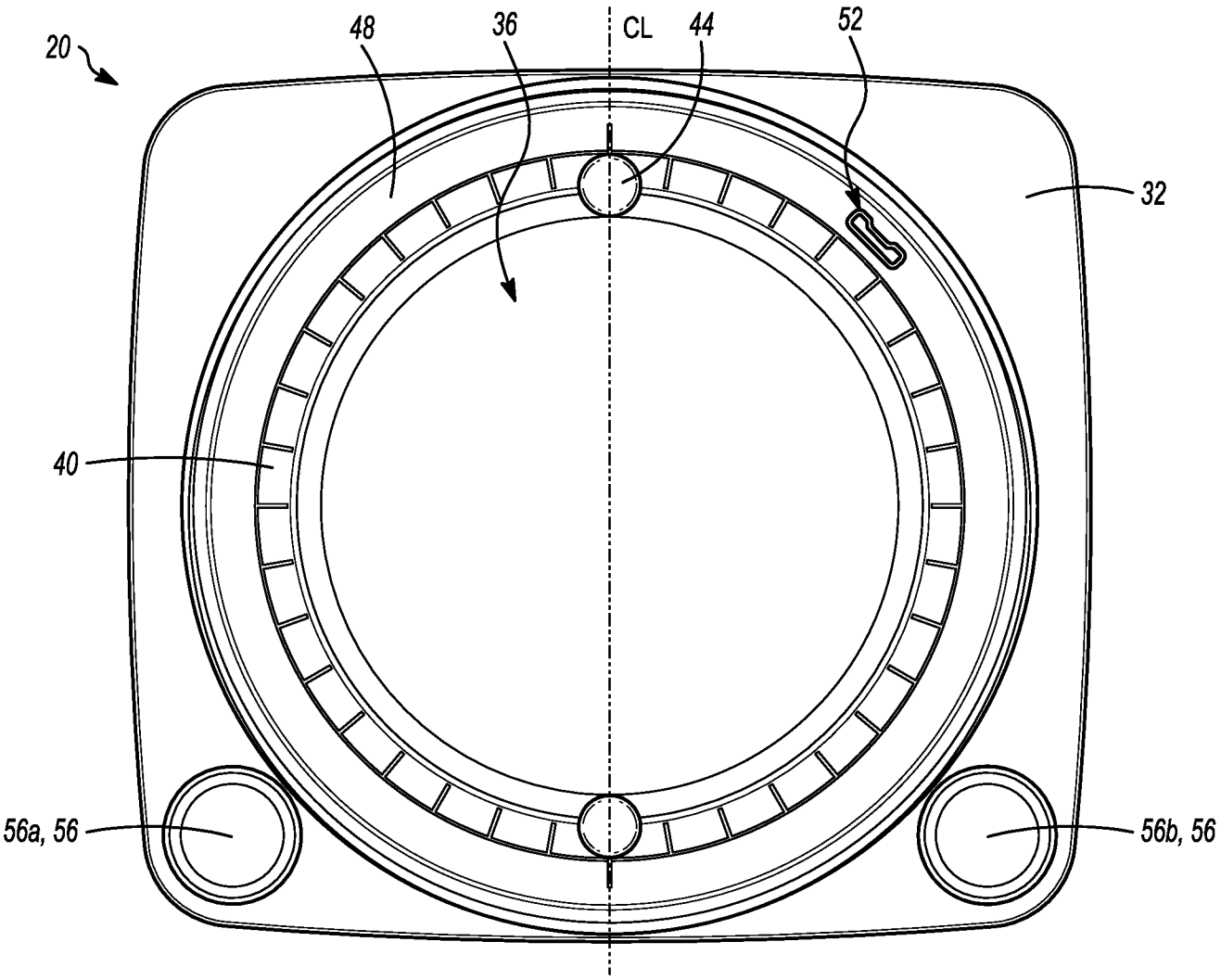
FIG. 1B is a plan view of the drawing device of FIG. 1A.
Figure 2A:
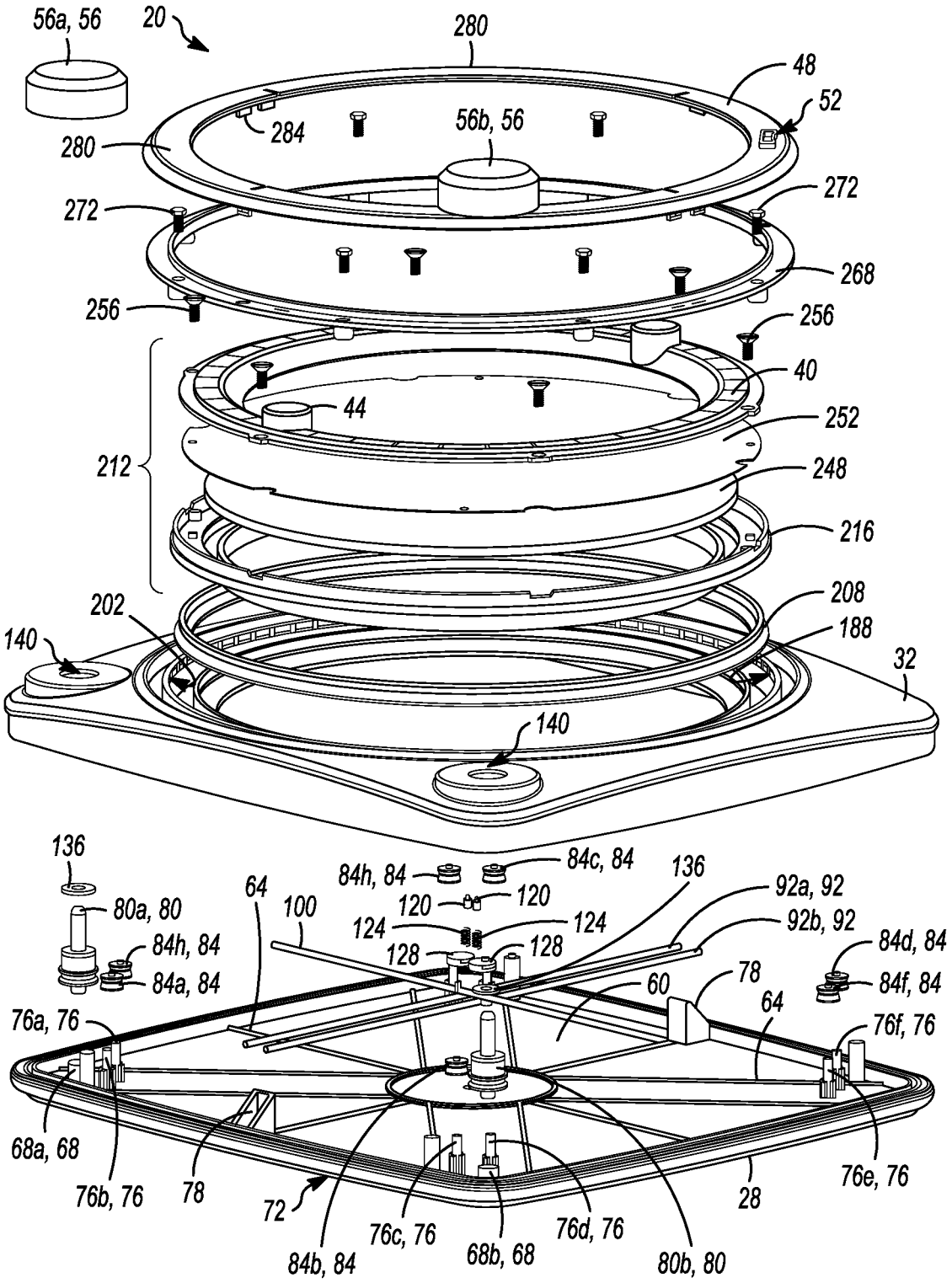
FIG. 2A is an exploded isometric view of the drawing device of FIGS. 1A and 1B.
Figure 2B:
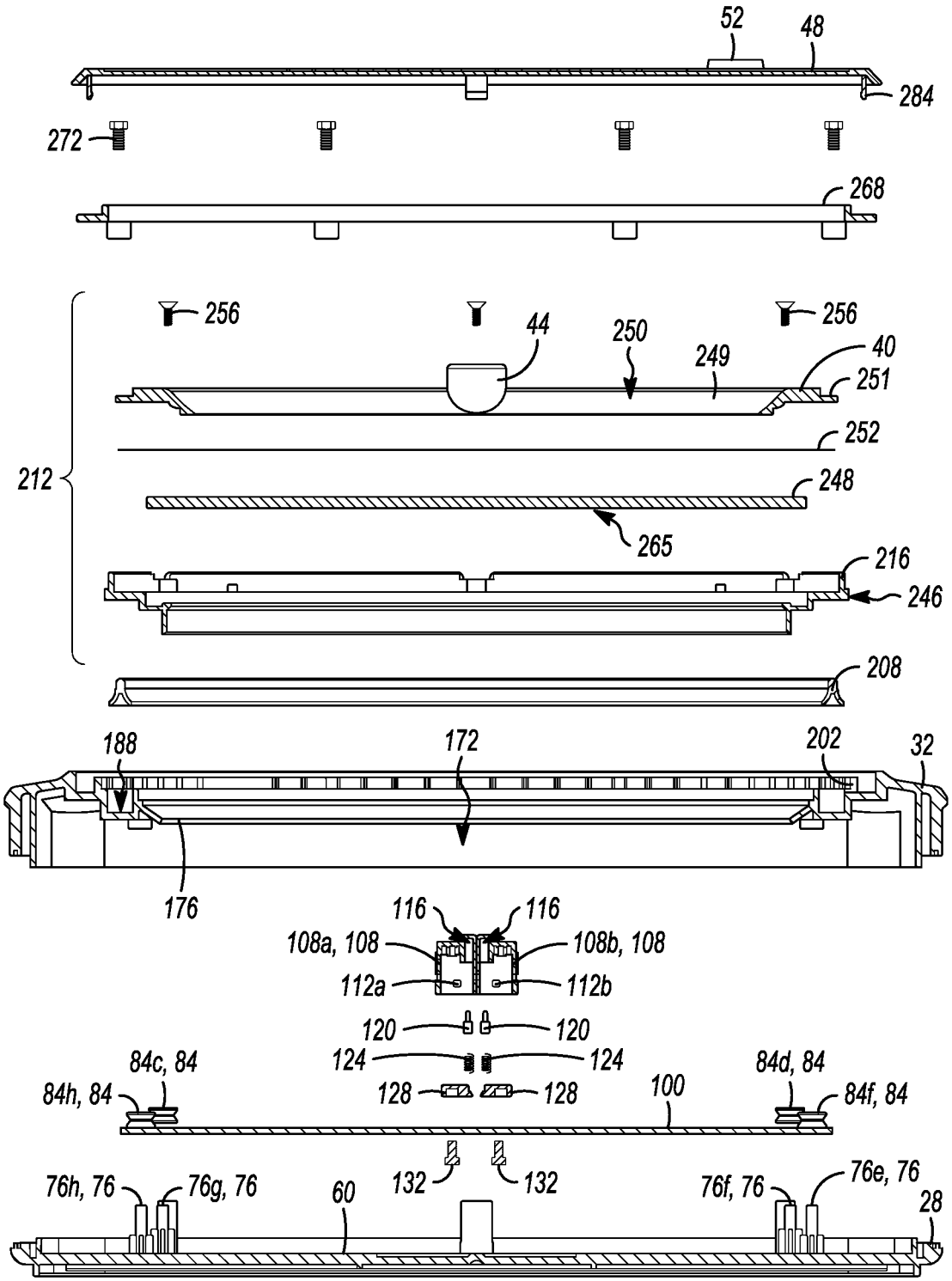
FIG. 2B is an exploded front elevation section view of the drawing device of FIGS. 1A and 1B.
Figure 2C:
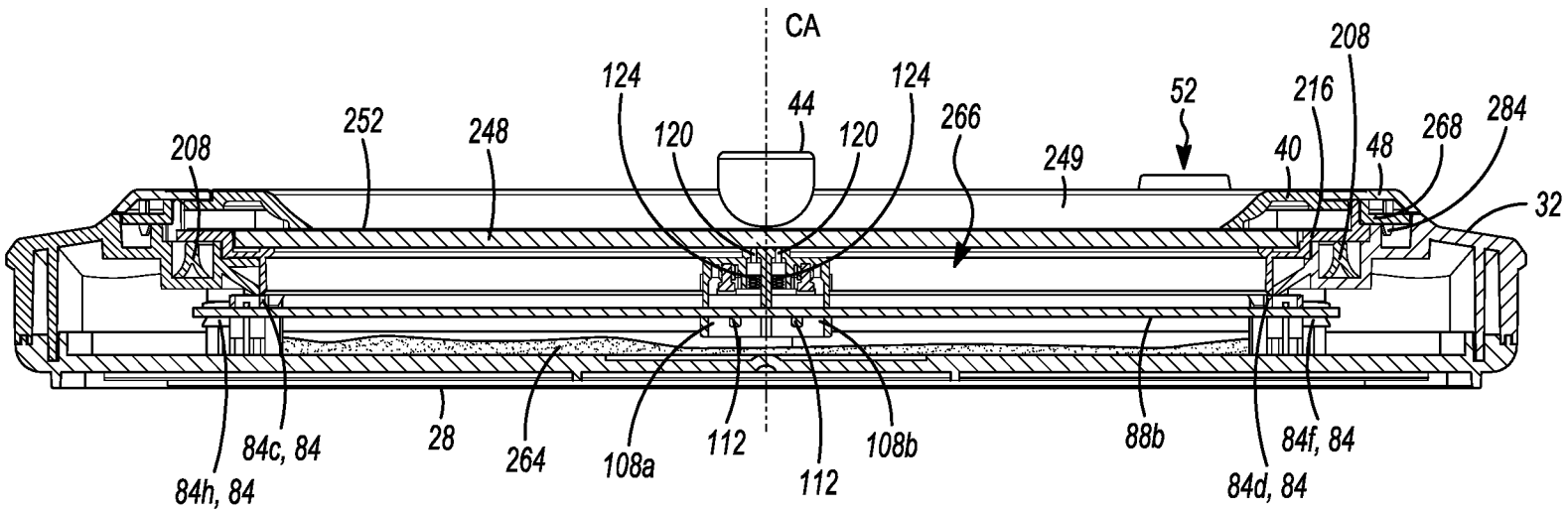
FIG. 2C is a front elevation section view of the drawing device of FIGS. 1A and 1B.
Figure 2D:
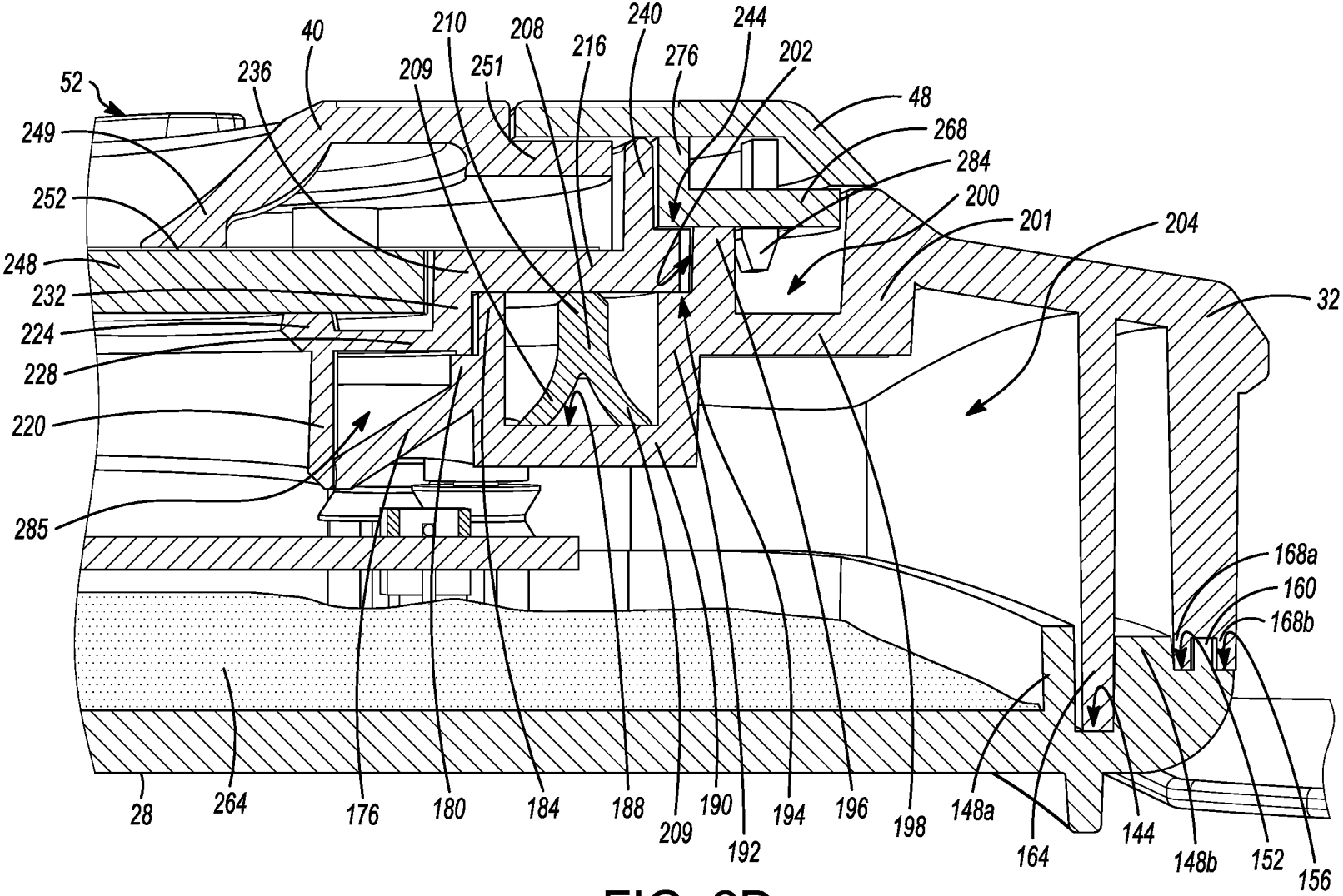
FIG. 2D is a partial front elevation section view of a periphery of the drawing device of FIGS. 1A and 1B.

FIGS. 1A and 1B show a drawing device 20 in accordance with an embodiment thereof, having a generally cuboid housing 24. The housing 24 includes a lower housing 28 and an upper housing 32 that are both formed of a molded plastic. A generally circular display screen 36 is positioned in the upper housing 32, and is encircled by a bezel 40 that has a pair of rotation knobs 44. The bezel is made of a molded plastic. An outer display frame 48 of the upper housing 32 encircles the bezel 40 and has a template connector slot 52 on a top surface thereof. A pair of control knobs 56*a*, 56*b* (also referred to herein as knob(s) 56) are rotatably supported by the upper housing 32. In other embodiments, the housing can be any other suitable shape, such as generally cylindrical, ovoid, irregular, etc. Further, the display screen can be many other shapes, such as square, hexagonal, octagonal, triangular, irregular, etc.

The various components of the drawing device 20 will now be described with reference to FIGS. 2A to 2D and 3A. The lower housing 28 has a generally planar pan 60 across which run a number of reinforcement ribs 64. A pair of tubular control mounting sleeves 68*a*, 68*b* (also referred to herein as tubular control mounting sleeve(s) 68) extend from the pan 60 adjacent to each of two corners thereof along a front longitudinal edge 72 of the lower housing 28. Two pulley mounting posts 76*a*, 76*b* (also referred to herein as knob(s) 76) extend from the pan 60 adjacent each of the four corners of the lower housing 28. The pulley mounting posts 76*a*, 76*b* have radially extending elevation supports along lower portions thereof. A pair of crossover limiters 78 extend from the pan 60 along the longitudinal sides thereof.

A first positioning structure in the form of a lateral stylus control assembly includes a master pulley 80*a* coupled to a set of slave pulleys 84*a* to 84*d*. The master pulley 80*a* has a single groove extending about its circumference and a post extending axially in either direction, one end of which is freely rotatably seated in the tubular control mounting sleeve 68*a*. Each of the slave pulleys 84*a* to 84*d* has a single groove extending about its circumference. An aperture extends axially through the slave pulleys 84*a* to 84*d*, which are freely rotatably mounted on the pulley mounting posts 76*b*, 76*c*, 76*g*, and 76*f* respectively. A first endless cable 88*a* extends under tension around the master pulley 80*a* and the slave pulley 84*a* in a crisscross configuration. The tension on the first endless cable 88*a* is sufficient so that rotation of the master pulley 80*a* causes the slave pulley 84*a* to rotate in the opposite rotational direction. The slave pulley 84*a* is coupled to and forms a set with another slave pulley 84*b* via an endless cable 88*b* under tension so that rotation of the slave pulley 84*a* causes rotation of the other slave pulley 84*b* in the same rotational direction. Clockwise rotation of the slave pulley 84*a* causes a delivery portion $\mathbf{88}b_d$ of the endless cable 88*b* to travel towards the slave pulley 84*b* and a return portion $\mathbf{88}b_r$ of the endless cable 88*b* to travel towards the slave pulley 84*a*. Similarly, counter-clockwise rotation of the slave pulley 84*a* causes a delivery portion $\mathbf{88}b_d$ to travel towards the slave pulley 84*a* and the return portion $\mathbf{88}b_r$ to travel towards the slave pulley 84*b*.

The slave pulley 84*a* is also coupled to another slave pulley 84*c* via an endless cable 88*c* configured in a crisscross configuration and under tension so that rotation of the slave pulley 84*a* causes rotation of the other slave pulley 84*c* in the opposite rotational direction. The slave pulley 84*c* is also coupled to and forms a set with another slave pulley 84*d* via an endless cable 88*d* under tension so that rotation of the slave pulley 84*c* causes rotation of the other slave pulley 84*d* in the same rotational direction. Clockwise rotation of the slave pulley 84*c* causes a delivery portion 88$d_d$ of the endless cable 88*d* to travel towards the slave pulley 84*c* and a return portion 88$d_r$ of the endless cable 88*d* to travel towards the slave pulley 84*d*. Similarly, counter-clockwise rotation of the slave pulley 84*c* causes a delivery portion 88$d_d$ to travel towards the slave pulley 84*d* and the return portion 88$d_r$ to travel towards the slave pulley 84*c*.

A second positioning structure in the form of a longitudinal stylus control assembly is somewhat similar to the lateral stylus control assembly and includes a master pulley 80*b* coupled to a set of slave pulleys 84*e* to 84*h*. The master pulley 80*b* has a single groove extending about its circumference and a post extending axially in either direction, one end of which is freely rotatably seated in the tubular control mounting sleeve 68*b*. The slave pulley 84*e* has three grooves extending about its circumference, the slave pulley 84*g* has two grooves extending about its circumference, and the slave pulleys 84*f* and 84*h* each have one groove extending about their circumference. An aperture extends axially through the slave pulleys 84*e* to 84*h*, which are freely rotatably mounted on the pulley mounting posts 76*d*, 76*e*, 76*a*, and 76*h* respectively. An endless cable 88*e* extends around the master pulley 80*b* and the slave pulley 84*e* in a crisscross configuration so that rotation of the master pulley 80*b* causes the slave pulley 84*e* to rotate in the opposite rotational direction. The slave pulley 84*e* is coupled to and forms a set with another slave pulley 84*f* via an endless cable 88*f*, so that rotation of the slave pulley 84*e* causes rotation of the other slave pulley 84*f* in the same rotational direction. Clockwise rotation of the slave pulley 84*e* causes a delivery portion 88$f_d$ of the endless cable 88*f* to travel towards the slave pulley 84*f* and a return portion 88$f_r$ of the endless cable 88*f* to travel towards the slave pulley 84*e*. Similarly, counter-clockwise rotation of the slave pulley 84*e* causes a delivery portion 88$f_d$ to travel towards the slave pulley 84*e* and the return portion 88$f_r$ to travel towards the slave pulley 84*f*.

The slave pulley 84*e* is also coupled to another slave pulley 84*g* via an endless cable 88*g* configured in a crisscross configuration so that rotation of the slave pulley 84*e* causes rotation of the other slave pulley 84*g* in the opposite rotational direction. The slave pulley 84*g* is also coupled to and forms a set with another slave pulley 84*h* via an endless cable 88*h* so that rotation of the slave pulley 84*g* causes rotation of the other slave pulley 84*h* in the same rotational direction. Clockwise rotation of the slave pulley 84*g* causes a delivery portion 88$h_d$ of the endless cable 88*h* to travel towards the slave pulley 84*h* and a return portion 88$h_r$ of the endless cable 88*h* to travel towards the slave pulley 84*g*. Similarly, counter-clockwise rotation of the slave pulley 84*g* causes a delivery portion 88$h_d$ to travel towards the slave pulley 84*g* and the return portion 88$h_r$ to travel towards the slave pulley 84*h*.

The first endless cables 88 are constructed of fishing line, but can be made of any other suitable material. Further, the endless cables 88 can be replaced with other arrangements of lengths of cable extending between pulleys and wrapped therearound to enable bi-directional control of the stylus guides. While the slave pulleys 84 are constructed with a single groove within which the endless cables 88 are received, it will be appreciated that each of the slave pulleys 84 can have more than one groove and may have a separate groove for each endless cable 88 extending around it.

A first lateral stylus guide 92*a* is secured to the delivery portion 88$b_d$ of the endless cable 88*b* and to the return portion 88$d_r$ of the endless cable 88*d* via a pair of fixing clips 96*a*, 96*b* respectively. A second lateral stylus guide 92*b* is secured to the return portion 88$b_r$ of the endless cable 88*b* and to the delivery portion 88$d_d$ of the endless cable 88*d* via another pair of fixing clips 96*c*, 96*d* respectively. The fixing clips 96*a* and 96*b* are coupled to portions of the endless cables 88*b* and 88*d* that travel in the same lateral direction to one another and in an opposite lateral direction to the portions of the endless cables 88*b* and 88*d* on which the fixing clips 96*c* and 96*d* are located. When the master pulley 80*a* is rotated, the first and second lateral stylus guides 92*a*, 92*b* (which may be referred to collectively as the lateral stylus guides 92) travel laterally towards or away from each other in opposite directions $d_{11}$ and $d_{12}$, depending on the rotational direction in which the master pulley 80*a* is rotated. Directions $d_{11}$ and $d_{12}$ are parallel to a lateral line LL that acts as a first axis.

A longitudinal stylus guide 100 is secured to the return portions 88$f_r$, 88$h_r$ of the endless cables 88*f*, 88*h* respectively that travel in the same longitudinal direction to one another via a pair of fixing clips 96*e*, 96*f* respectively. When the master pulley 80*b* is rotated, the longitudinal stylus guide 100 travels longitudinally in a direction $d_{21}$ or $d_{22}$ determined by the direction in which the master pulley 80*b* is rotated. Directions are parallel to a center line CL that acts as a second axis which is orthogonal to the lateral line LL.

A first stylus assembly includes a stylus carriage 108*a* has two orthogonal through-holes 112*a* in which the first lateral stylus guide 92*a* and the longitudinal lateral stylus guide 100 can be slidably received. A second stylus assembly includes a second stylus carriage 108*b* that is a mirror image of the stylus carriage 108*a* and has two orthogonal through-holes 112*b* in which the second lateral stylus guide 92*b* and the longitudinal lateral stylus guide 100 can be slidably received. Each of the stylus carriages 108*a*, 108*b* (which may be referred to hereinafter collectively as stylus carriages 108) has a stylus channel 116 with a lip at its top opening and in which a stylus 120 is received at a bottom end thereof. The stylus 120 has a shoulder that abuts against the lip to limit upward travel of the stylus 120 out of the stylus channel 116. A biasing spring 124 is inserted into the stylus channel below the stylus 120, and a cap 128 is secured inside a cavity of the stylus carriage 108 via a screw 132 to seal the stylus 120 and the biasing spring 124 in the stylus channel 116.

Once the stylus carriages 108 are assembled, they can be deployed on the lateral stylus guides 92 and the longitudinal stylus guide 100 before the lateral stylus guides 92 and the longitudinal stylus guide 100 are secured to the endless cables 88. The insertion of the lateral stylus guides 92 and the longitudinal stylus guide 100 orthogonal through-holes 112*a*, 112*b* of the stylus carriages 108 inhibit reorientation of the stylus carriages 108*a*, 108*b* when slidingly mounted on the lateral stylus guides 92 and the longitudinal stylus guide 100.

A rubber gasket 136 is placed atop of the upper end of the post of each master pulley 80*a*, 80*b*.

The upper housing 32 has a set of cylindrical sleeves extending downwards on an undersurface thereof aligning with the positions of the pulley mounting posts 76 on the lower housing 28. Further, a pair of control pass-throughs 140 extend through the upper housing 32 and align axially with the tubular control mounting sleeves 68*a*, 68*b* of the lower housing 28.

The lower housing 28 and the upper housing 32 have a peripheral sealing structure to seal the periphery thereof when they are joined. In particular, the lower housing 28 has a deep channel 144 extending about its periphery between two ridges 148*a*, 148*b*, and a shallow channel 152 and a ledge 156 on either side of a ridge 160 closer to its periphery. The upper housing 32 has an elongated ridge 164 that is received within the deep channel 144 when the lower and upper housing 28, 32 are aligned and mated. In addition, two ridges 168*a*, 168*b* of the upper housing 32 are received within the shallow channel 152 and by the ledge 156 of the lower housing 28. The elongated ridge 164 and the ridges 168*a*, 168*b* are secured within the deep channel 144 and the shallow channel 152, and to the ledge 156 respectively via an adhesive or some other suitable means.

When the lateral stylus control assembly, the longitudinal stylus control assembly, and the stylus assemblies are assembled atop of the lower housing 28, the upper housing 32 is aligned with the lower housing 28 and permanently secured thereto about the peripheral sealing structure via an epoxy or another suitable adhesion method. The rubber gaskets 136 seal the control pass-throughs 140.

The upper housing 32 has a generally circular display screen aperture 172 that is surrounded by an angled lip 176 that extends from a shoulder 180. The angled lip 176 extends inwardly and downwardly. The shoulder 180 has a flat horizontal upper surface. A generally tubular first wall 184 is positioned beside and extends above the shoulder 180. A first annular surface 190 extends outwardly from a bottom end of the first wall 184, and is generally horizontal. The first wall 184 and the first annular surface 190 form an inner U-shaped channel 188 in conjunction with a second generally tubular wall 192 extending upwards from a distal end of the first annular surface 190. The upper surfaces of the first wall 184 and the second wall 192 are generally horizontally co-planar. An upper surface 194 of the first wall 184 is generally horizontally co-planar with an upper surface of the second wall 192. The second wall 192 is bordered by a third generally tubular wall 196 that extends above the upper surface 194 of the second wall 192. A second annular surface 198 extends outwards from a lower end of the third wall 196. The second annular surface 198 defines an outer U-shaped channel 200 with the third wall 196 and a fourth generally tubular wall 201. A set of detents 202 in the form of vertically aligned grooves are positioned at regular intervals along an inner surface of the third wall 196.

The upper housing 32 and the lower housing 28, when joined, form the housing 24 that is a generally hollow shell that defines a cavity 204 therein that is in communication with the display screen aperture 172. The upper ends of the posts of the master pulleys 80*a*, 80*b* protrude through the control pass-throughs 140.

A compressible, inverted Y-ring 208 made of rubber or another suitable material is placed in the inner U-shaped channel 188. While somewhat compliant, the Y-ring 208 is sufficiently rigid so that, when placed in the inner U-shaped channel 188, lower edges 209 of the Y-ring 208 engage the first wall 184 and the second wall 192 of the U-shaped channel 188 and resist compression of an upper edge 210 of the Y-shaped ring 208. Any other suitable type of sealing element can be employed in the inner U-shaped channel 188 in place of the Y-ring. For example, an O-ring can be used.

A display screen assembly 212 is seated atop of the housing 24, and includes a screen frame 216 that is moulded from plastic. The screen frame 216 has a generally tubular stylus limiter 220, from which a screen support 224 extends upwardly. The screen support 224 has an annular planar top surface configured to support a screen. A first annular horizontal portion 228 extends outwardly radially relative to a central axis CA of the screen support 224. The central axis CA is generally aligned with a vertical axis when the drawing device 20 is placed atop of a horizontal surface. A first generally tubular wall 232 extends vertically from the peripheral edge of the first annular horizontal portion 228, with a second annular horizontal portion 236 extending radially outwardly relative to the central axis CA from an upper end of the first wall 232. A second generally tubular wall 240 extends vertically upwardly from the second annular horizontal portion 236 and has a peripheral shoulder 244. A positioning projection 246 extends from a peripheral edge of the screen frame 216 and is spring biased radially outwardly relative to the central axis CA.

A generally circular, flat display panel 248 is positioned atop of the screen support 224 and extends to the first wall 232. The display panel 248 is made of a transparent material, such as a tempered or other glass, plastic, etc., that is preferably resistant to fracturing.

The bezel 40 has a beveled surface 249 that slopes inwardly towards a viewing aperture 250, and has a vertically recessed peripheral shoulder 251. The two rotation knobs 44 protrude from opposite sides of a top surface of the bezel 40.

A protective layer 252 is bonded to a bottom surface of the bezel 40. The protective layer 252 is a thin, generally transparent plastic layer that is shatter-resistant and extends further radially relative to the central axis CA than the display panel 248.

After securing the protective layer 252 to the bezel 40, the bezel 40 is secured to the screen frame 216 via a set of screws 256 inserted into a set of screw holes in the bezel 40 and the screen frame 216. When the bezel 40 is secured to the screen frame 64, the protective layer 68 is positioned against the display panel 248.

A fine, metallic powder 264 is placed in the pan 60 prior to securing the display screen assembly 212 to the housing 24. The metallic powder 264 releasably adheres to the inner surface 265 of the display panel 248. One example of such a powder is an aluminum powder.

A retaining ring 268 is positioned atop of the peripheral shoulder 244 of the screen frame 216 and the third wall 196 of the upper housing 32, and secured to the upper housing 32 via a set of screws 272 to secure the display screen assembly 212 to the housing 24. The display screen assembly 212 is thus secured to the housing 24. When secured to the housing 24, the display screen assembly 212 is rotatable about the central axis CA. The positioning projection 246 engages the detents 202 to inhibit rotation of the display screen assembly 212, but application of a threshold torque force on the display screen assembly 212 via one or both of the rotation knobs 44 can cause positioning projection 246 to disengage from a detent 202 and allow rotation of the display screen assembly 212. When the positioning projection 246 encounters an adjacent detent 202, it engages it to inhibit further rotation of the display screen assembly 212 until a corresponding threshold torque force is applied to the display screen assembly 212.

A tubular flange 276 of the retaining ring 268 abuts against the second generally tubular wall 240 of the display screen assembly 212 to maintain its axial alignment as the display screen assembly 212 is rotated.

The outer display frame 48 is formed of two frame halves 280, each having a set of clips 284 that engage edges of corresponding clip holes in the retaining ring 268 to secure the frame halves 280 to the retaining ring 268 after fastening of the retaining ring 268 to the housing 24.

The control knobs 56*a* and 56*b* are secured to the upper post ends of the master pulleys 80*a* and 80*b* respectively via an epoxy or some other suitable means or method, so that rotation of the control knobs 56*a* and 56*b* rotates the master pulleys 80*a*, 80*b* respectively.

It is desirable to inhibit migration of the metallic powder 264 from the cavity 204 of the drawing device 20 outwards. If a substantial amount of the metallic powder 264 is lost due to migration out of the drawing device 20, the effectiveness of the drawing device 20 may be reduced. Further, escape of the metallic powder 264 out of the drawing device 20 can create an unsightly mess and/or hazard, particularly as the drawing device 20 may be operated by a child.

The contours of the display screen assembly 212 and the upper housing 32 provide a labyrinthian path between them to inhibit migration of the metallic powder 264 from the cavity 204 of the drawing device 20 outwards. When the display screen assembly 212 is secured atop of the housing 24, the stylus limiter 220 fits snugly within a lower edge of the angled lip 176, providing a first seal between the display screen assembly 212 and the housing 24. The stylus limiter 220, the angled lip 176, and the first annular horizontal portion 228 form an annular chamber 285 above the first seal. If metallic powder 264 makes it past the first seal between the stylus limiter 220 and the angled lip 176, it enters the annular chamber 285 and gravitates towards the first seal, encouraging it to migrate back into the cavity 204 of the drawing device 20. The first annular horizontal portion 228 engages the shoulder 180 of the upper housing 32 to provide a second seal at the top of the annular chamber 285 to inhibit further migration of the metallic powder beyond the annular chamber 285.

The second annular horizontal portion 236 abuts against an upper end of the first wall 184 to form a third seal preventing metallic powder 264 from migrating into the U-shaped channel 188. Any metallic powder entering the U-shaped channel 188 is inhibited from further migration by the Y-ring 208. The lower ends 209 of the Y-ring 208 are compressed against the first wall 184, the second wall 192, and the first annular surface 190 to provide additional seals to inhibit migration of the metallic powder 264 under the Y-ring 208. Further, the upper edge 210 of the compressed Y-ring 208 positioned in the U-shaped channel abuts against a bottom surface of the second annular horizontal portion 236 of the screen frame 216 to provide another seal.

Further, the bottom surface of the second annular horizontal portion 236 engages the shoulder 194 of the upper housing 32 to provide a further seal between the display screen assembly 212 and the housing 24. These serial seals effectively inhibit the escape of the metallic powder 264 from the cavity 204 and out of the drawing device 20.

When the display screen assembly 212 is positioned atop of the housing 24, the display panel 248 comes into contact with the styluses 120, compressing the biasing springs 124 while the styluses 120 recede within the stylus channels 116. The biasing springs urge the styluses 120 to maintain contact with the display panel 248 as the stylus carriages 108 are moved via the lateral and longitudinal stylus control assemblies. As an inside surface 265 of the display screen 248 is generally planar, the styluses 120 do not shift much vertically during movement of the stylus carriages 108. The bottom surface of the display screen assembly 212 and the cavity 204 of the housing 24 form an enclosure 266 in which the metallic powder 264 is enclosed.

Operation of the drawing device 20 will now be described with reference to FIGS. 1A to 3C. The metallic powder 264 within the enclosure 266 formed by the cavity 204 of the housing 24 and the display screen assembly 212 coats the surfaces in the enclosure 266, including the inner surface 265 of the display panel 248, rendering the appearance of the display screen 36 opaque to a user of the drawing device 20.

A user can rotate the control knob 56*a* secured to the master pulley 80*a* to cause the lateral stylus guides 92*a*, 92*b*, and thus the styli 120*a*, 120*b* to move away from and towards the center line CL in directions $d_{11}$ and $d_{12}$, so that movement of the styli 120*a*, 120*b* is mirrored about the center line CL. Further, the user can rotate the control knob 56*b* secured to the master pulley 80*b* to cause the longitudinal style guide 100, and thus the styli 120*a*, 120*b*, to simultaneously move in one of directions $d_{21}$ and $d_{22}$ that are parallel to the center line CL and orthogonal to the lateral line LL. As the user controls movement of the styluses 120*a*, 120*b*, they mirror each other's movement about the center line CL. Both the center line CL and the lateral line LL are generally parallel to the inner surface of the display panel 248 of the display screen 36.

Figure 3A:
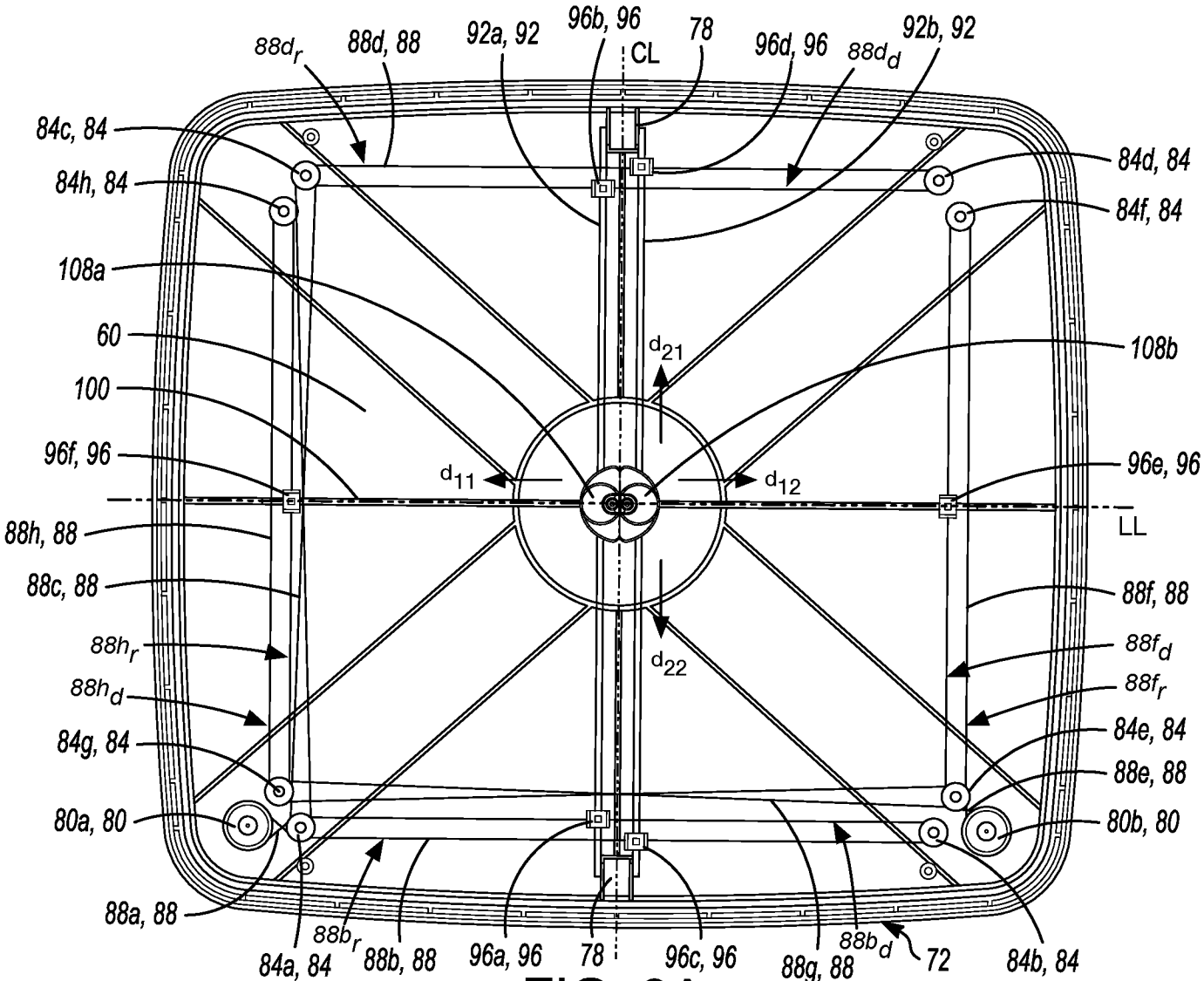
FIG. 3A is a plan view of positioning structures of the drawing device of FIGS. 1A and 1B positioning styli in first positions.

In FIG. 3A, the styluses 120*a*, 120*b* are shown in a first central position adjacent one another. Abutment of the stylus carriages 108*a*, 108*b* inhibits further rotation of the control knob 56*a* counter-clockwise. The control knob 56*a* can be turned clockwise to cause the stylus carriages 108*a*, 108*b*, and thus the styluses 120*a*, 120*b* to simultaneously move laterally away from the central position. Similarly, rotation of the control knob 56*b* clockwise or counter-clockwise causes the stylus carriages 108*a*, 108*b* to move longitudinally towards or away from, respectively, the control knobs 56*a*, 56*b*. The crossover limiters 78 prohibit movement of the fixing clips 96*a* and 96*c*, and the fixing clips 96*b* and 96*d* towards each other and, thus, stylus guides 92*a*, 92*b* to and past the center line CL.

Figure 3B:
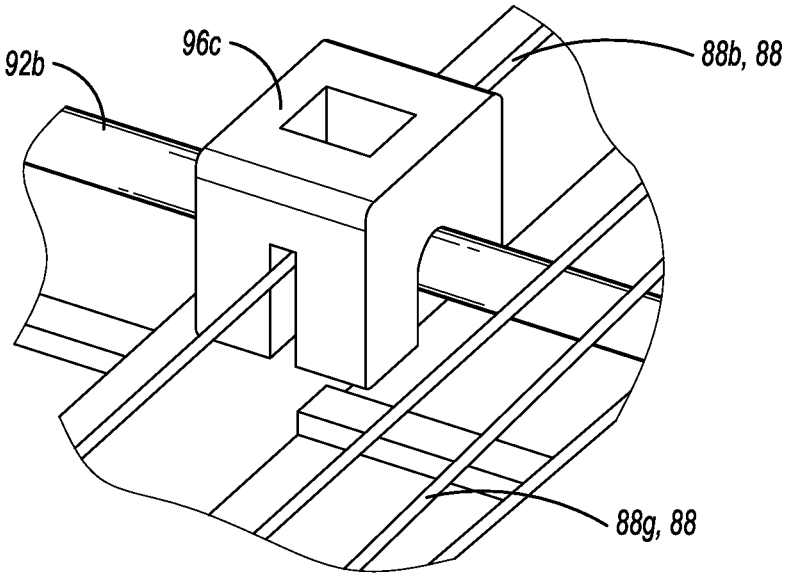
FIG. 3B is an isometric view of a fixing clip of the positioning structures of FIG. 3A.

FIG. 3B shows an exemplary fixing clip 96 coupled to an endless cable 88. In particular, the fixing clip 96*c* has a slot in which the endless cable 88*b* is inserted, and an aperture perpendicular to the slot through which the stylus guide 92*b* is inserted. The stylus guide 92*b*, when inserted through the aperture, secures the endless cable 88*b* to the fixing clip 96*c* within the slot. Further, the fixing clip 96*c* positions the stylus guide 92*b* below the plane in which the endless cables 88*b*, 88*g* extend. Each of the fixing clips 96 is similar in configuration and function to the fixing clip 96*c*.

Figure 3C:
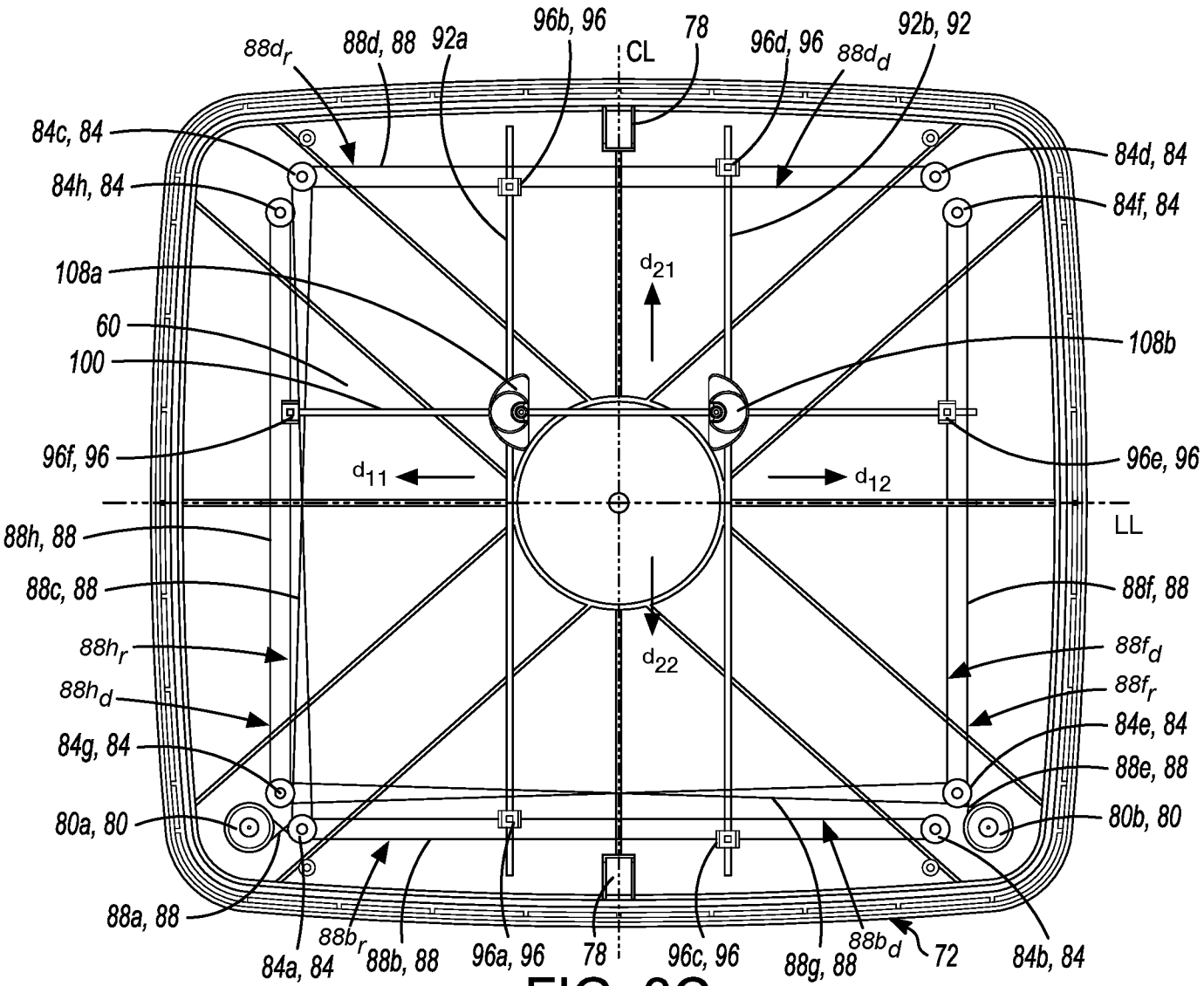
FIG. 3C is a plan view of the positioning structures of the drawing device of FIGS. 1A and 1B positioning the styli in second positions.

FIG. 3C shows the position of the styluses 120*a*, 120*b* in a second position after clockwise rotation of the control knob 56*a* and counter-clockwise rotation of the control knob 56*b*. As shown, rotation of the control knob 56*a* has simultaneously caused the stylus carriage 108*a* to move in the direction dig and the stylus carriage 108*b* to move in the direction $d_{12}$ away from the center line CL. Further, rotation of the control knob 56*b* has caused both of the stylus carriages 108*a* and 108*b* to simultaneously move in the direction $d_{21}$.

As will be understood, a user can manipulate both of the control knobs 56*a*, 56*b* simultaneously.

As the styluses 120 are moved across the inside surface 265 of the display screen 248, they physically remove the metallic powder 264 adhered to the inside surface 265 along their path. The uncoated display panel 248 provides a darker appearance to a user, thus visibly marking the display screen 36.

Movement of the styluses 120*a*, 120*b* laterally or longitudinally beyond the edge of the display panel 248 is inhibited by abutment of the stylus carriages 108*a*, 108*b* against the stylus limiter 220.

The display screen assembly 212 can be rotated relative to the housing 24 and, thus, the styluses 120*a*, 120*b* via clockwise or counterclockwise movement of the rotation knobs 44. As the display screen assembly 212 is rotated, the display panel 248 is rotated, thereby causing the stationary styluses 120*a*, 120*b* to remove the metallic powder 264 along arcuate paths. In this manner, arcuate lines may be drawn using the drawing device 20.

The detents 202 on the upper housing 32 and the positioning projection 246 of the display screen assembly 212 provide a screen orientation control structure that enables pre-determined incremental rotation of the display screen assembly 212. The detents 202 are vertical grooves along the upper housing 32 that are engaged by the positioning projection 246 on the peripheral surface of the screen frame 216 to inhibit rotation of the display screen assembly 212. Upon application of a threshold torqueing force applied via the rotation knob(s) 44, the positioning projection 246 disengages a corresponding detent 202, allowing the display screen assembly 212 to relatively freely rotate until the positioning projection 246 engages a subsequent detent 202. Where the detents 202 are regularly spaced along the periphery of the upper housing 32, the display screen assembly 212 can be rotated a regular angular amount between movements of the styluses via the control knobs 56, for example, to draw a repeating pattern along an arcuate path.

Figure 4:
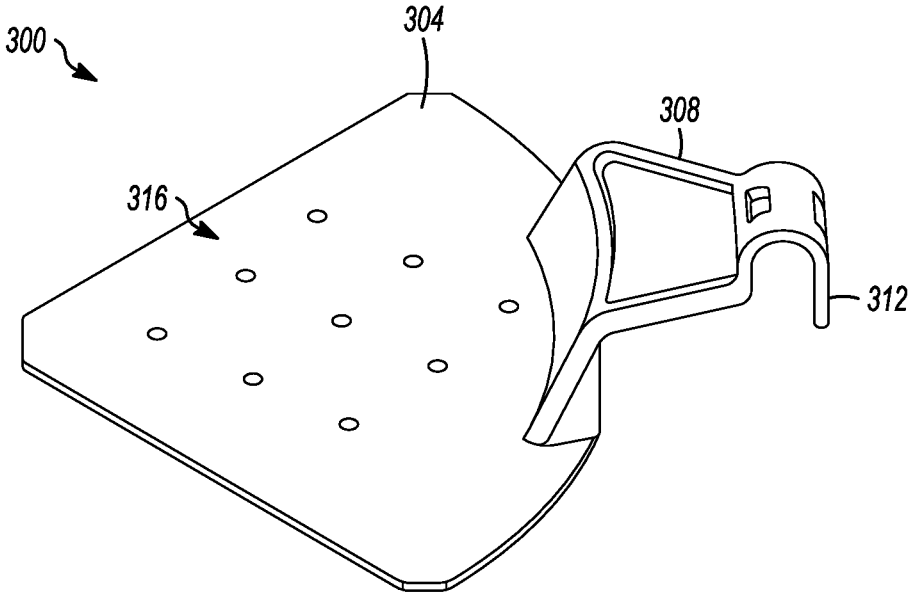
FIG. 4 is a top front left isometric view of a template for use with the drawing device of FIGS. 1A and 1B.

FIG. 4 shows a template 300 for use with the drawing device 20 of FIGS. 1A to 3B. The template is made of clear acrylic and has a tracing plate 304 that can be fitted over the display screen 36. An anchor arm 308 extends from a side of the tracing plate 304 and ends in an anchor projection 312. The anchor projection 312 can be releasably secured within the template connector slot 52 of the outer display frame 48. The anchor arm 308 is dimensioned to enable the rotation knobs 44 to travel thereunder as the display screen assembly 212 is rotated. The tracing plate 304 has an array of reference indicia 316 that can be used as reference locations to move the stylus 120*b*. The array of reference indicia 316 is a set of small bumps on the surface of the tracing plate 304, but can be small recesses or any other formation, and additionally or alternatively can be markings on the tracing plate 304. An erasable marker can be used with the tracing plate 304 to indicate points and/or lines of a pattern.

Figure 5:
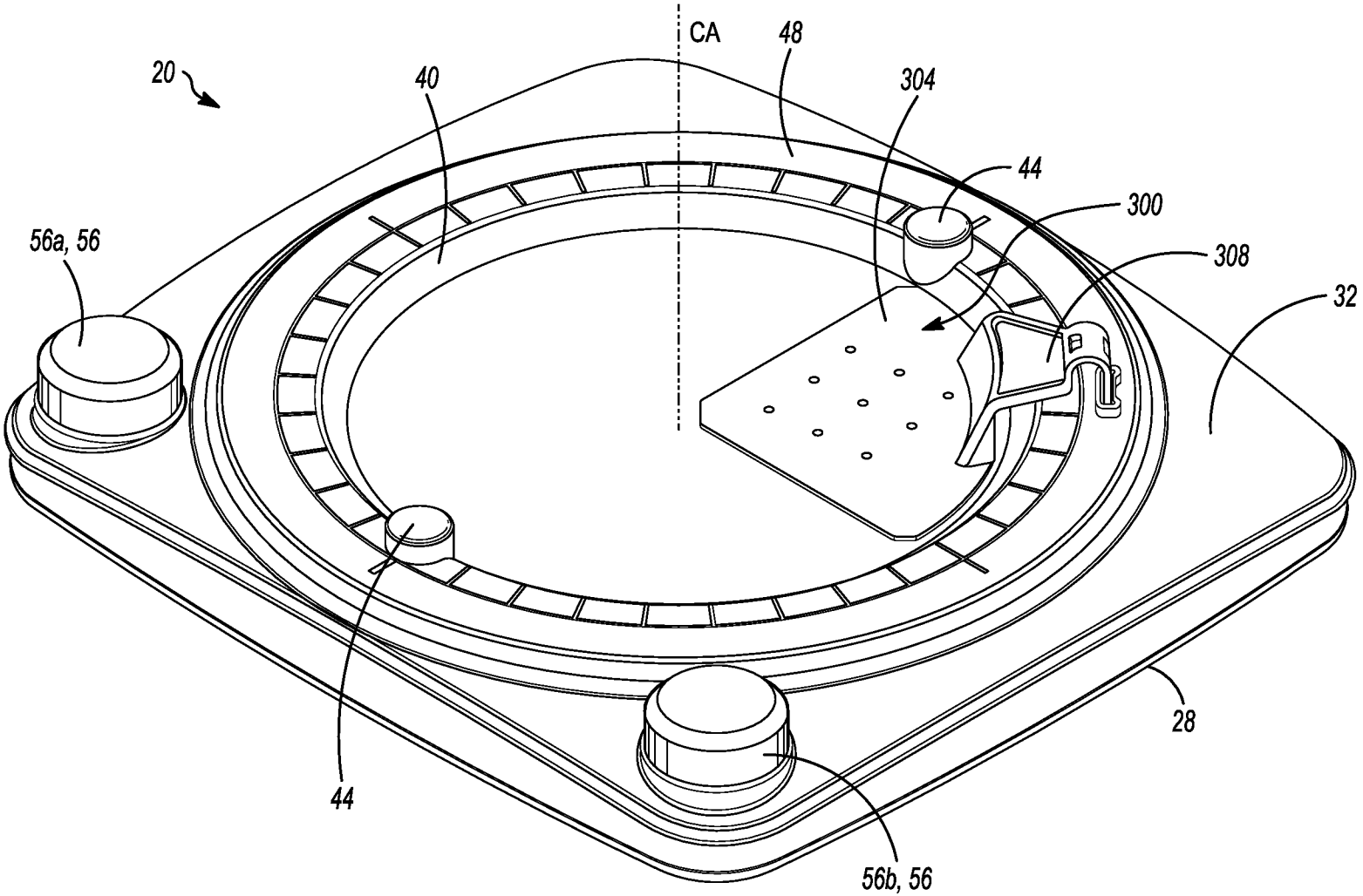
FIG. 5 is a top left front isometric view of the drawing device of FIGS. 1A and 1B with the template of FIG. 4 coupled thereto.

FIG. 5 shows the template 300 after attachment to the drawing device 20 of FIGS. 1A and 1B.

One or more design blueprints can be provided with the template 300 to indicate a pattern of movement of the stylus 120*b* relative to the array of reference indicia 316 in between regularly-sized rotations of the display screen assembly 212.

While, in the above-described and illustrated embodiment, the display screen is rotated via a pair of rotation knobs thereof, other types of display screen rotation controls can be employed. For example, a third control knob can be provided rotatably supported by the housing and being coupled to a rotation structure, such as a set of one or more gears, within the housing for rotating the display screen assembly relative to the housing.

The drawing device can have a single stylus or more than two styli that are movable via controls on the outside of the drawing device. For example, by having a stylus that is movable along a single axis and a display screen that is rotatable relative to a housing, various designs can be generated.

While, in the above-described and illustrated embodiment, the two positioning structures include cable and pulley arrangements to position styli relative to a display screen, other forms of positioning structures for moving one or more styli can be employed. For example, sliders coupled to one or more styli within the drawing device can be positioned on the exterior of the housing. The sliders may be, in one particular embodiment, magnetically coupled to an actuated element within the housing to reduce the number of apertures in the housing to be sealed. In another example, the positioning structure can be a mechanism for adjusting a position of a stylus along an axis, and a display screen can be rotated relative to the stylus to generate two-dimensional drawings. In a further example, rotatable threaded bolts can engage mating components, such as nuts slidably received within channels, that are coupled to one or more styli. Externally extending ends of the bolts can be rotated to cause the bolts to be urged to travel in either direction along the channels to position the styli along a display screen. Other positioning structures will occur to those skilled in the art.

In other embodiments, the drawing device can have two or more styluses with mirrored movement, and a fixed display screen that may be of another shape, for example, generally rectangular.

Further, the positioning structure(s) can move the stylus or styli in directions that are oblique to one another in other embodiments.

Persons skilled in the art will appreciate that there are yet more alternative implementations and modifications possible, and that the above examples are only illustrations of one or more implementations. The scope, therefore, is only to be limited by the claims appended hereto.

The invention claimed is:

1. A drawing device, comprising:

a housing having a cavity therein;

a display screen sealingly rotatably coupled to the housing, an inner surface of which forms an enclosure with the cavity;

a powder contained within the enclosure, the powder being removably adherent to the inner surface of the display screen;

a first stylus controller supported on an exterior of the housing; and at least one positioning structure supported in the enclosure coupled to the first stylus controller to move a first stylus in a first set of directions that are parallel to a first axis, the first stylus removing the powder from the inner surface of the display screen through contact with the inner surface of the display screen.

2. A drawing device as claimed in claim 1, further comprising a second stylus controller supported on the exterior of the housing, wherein the at least one positioning structure is coupled to the second stylus controller to move the first stylus in a second set of directions that are parallel to a second axis.

3. A drawing device as claimed in claim 2, wherein the second axis is orthogonal to the first axis.

4. A drawing device as claimed in claim 2, wherein the inner surface of the display screen is planar, and the first and second axes are parallel to the inner surface of the display screen.

5. A drawing device as claimed in claim 1, wherein the at least one positioning structure additionally moves a second stylus in the first set of directions via the first stylus controller and in the second set of directions via the second stylus controller, the second stylus removing the powder from the inner surface of the display screen through contact with the inner surface of the display screen.

6. A drawing device as claimed in claim 1, further comprising a display screen rotation controller supported on the exterior of the housing and controlling rotation of the display screen relative to the housing.

7. A drawing device as claimed in claim 6, further comprising a rotation structure coupled to the display screen rotation controller and positioned within the cavity of the housing to reorient the display screen.

8. A drawing device as claimed in claim 1, wherein the display screen can form part of a display screen assembly having a feature permitting manual rotation thereof.

9. A drawing device as claimed in claim 1, wherein the inner surface of the display screen is planar.

10. A drawing device as claimed in claim 9, wherein the first axis is parallel to the inner surface of the display screen.

11. A drawing device as claimed in claim 1, wherein one of an assembly of the display screen and the housing has a set of detents that are regularly angularly displaced and engaged by a biasable feature on another of the assembly of the display screen and the housing, the display screen being rotatable upon application of a threshold torque force thereon.

12. A drawing device as claimed in claim 1, wherein the housing has a pan to which loose powder can fall that is positioned below a seal between the housing and the display screen.

13. A drawing device, comprising:

a housing having a cavity therein;

a display screen sealingly coupled to the housing, an inner surface of which forms an enclosure with the cavity;

a powder contained within the enclosure, the powder being removably adherent to the inner surface of the display screen;

a first stylus controller supported on an exterior of the housing; and at least one positioning structure supported in the enclosure coupled to the first stylus controller to simultaneously move a first stylus and a second stylus in a first set of directions that are parallel to a first axis, the first stylus and the second stylus removing the powder from the inner surface of the display screen through contact with the inner surface of the display screen, wherein the at least one positioning structure simultaneously moves the first stylus in a first of the first set of directions and the second stylus in a second stylus in a second of the first set of directions that is opposite the first of the first set of directions.

14. A drawing device as claimed in claim 13, further comprising a second stylus controller supported on the exterior of the housing, wherein the at least one positioning structure is coupled to the second stylus controller to simultaneously move the first stylus and the second stylus in a second set of directions that are parallel to a second axis.

15. A drawing device as claimed in claim 14, wherein the second axis is orthogonal to the first axis.

16. A drawing device as claimed in claim 13, wherein the at least one positioning structure simultaneously moves the first stylus and the second stylus in a first of the second set of directions.

17. A drawing device as claimed in claim 13, wherein the at least one positioning structure comprises:

a first set of pulleys;

a first endless cable routed around the first set of pulleys and having a delivery portion and a return portion;

wherein the first stylus is coupled to the delivery portion of the first endless cable; and wherein the second stylus is coupled to the return portion of the first endless cable.

18. A drawing device as claimed in claim 17, wherein the at least one positioning structure comprises:

a second set of pulleys; and a second endless cable routed around the second set of pulleys and having a delivery portion and a return portion, wherein the first stylus is coupled to the delivery portion of the second endless cable that is simultaneously moved with the delivery portion of the first endless cable in a first direction, and wherein the second stylus is coupled to the return portion of the second endless cable that is simultaneously moved with the return portion of the first endless cable in a second direction opposite the first direction.

19. A drawing device as claimed in claim 18, wherein the at least one positioning structure comprises:

a third set of pulleys;

a third endless cable routed around the third set of pulleys and having a delivery portion and a return portion;

a fourth set of pulleys; and a fourth endless cable routed around the fourth set of pulleys and having a delivery portion and a return portion, wherein the first stylus and the second stylus are coupled to the delivery portion of the third endless cable and the fourth endless cable that simultaneously move in a third direction.

* * * * *